US009856553B2

(12) United States Patent
Ohsaki et al.

(10) Patent No.: US 9,856,553 B2
(45) Date of Patent: Jan. 2, 2018

(54) NI-BASED SUPERALLOY WITH EXCELLENT UNSUSCEPTIBILITY TO SEGREGATION

(75) Inventors: Satoru Ohsaki, Muroran (JP); Tatsuya Takahashi, Muroran (JP); Koji Kajikawa, Muroran (JP); Eiji Maeda, Muroran (JP); Yoshikuni Kadoya, Nagasaki (JP); Ryuichi Yamamoto, Hyogo (JP); Takashi Nakano, Tokyo (JP)

(73) Assignee: THE JAPAN STEEL WORKS, LTD., Tokyo (JP)

( * ) Notice: Subject to any disclaimer, the term of this patent is extended or adjusted under 35 U.S.C. 154(b) by 0 days.

(21) Appl. No.: 12/867,668

(22) PCT Filed: Feb. 13, 2009

(86) PCT No.: PCT/JP2009/052426

§ 371 (c)(1),
(2), (4) Date: Aug. 13, 2010

(87) PCT Pub. No.: WO2009/102028

PCT Pub. Date: Aug. 20, 2009

(65) Prior Publication Data

US 2010/0310411 A1 Dec. 9, 2010

(30) Foreign Application Priority Data

Feb. 13, 2008 (JP) ..... 2008-031506

(51) Int. Cl.

| | |
|---|---|
| ***C22F 1/10*** | (2006.01) |
| ***C22C 19/05*** | (2006.01) |
| ***B22D 7/00*** | (2006.01) |
| *C22B 9/00* | (2006.01) |

(52) U.S. Cl.

CPC ..... *C22F 1/10* (2013.01); *B22D 7/005* (2013.01); *C22C 19/055* (2013.01); *C22C 19/056* (2013.01); *C22C 19/057* (2013.01); *C22B 9/006* (2013.01)

(58) Field of Classification Search

CPC ..... C22C 19/056; C22C 19/057; C22C 30/00
See application file for complete search history.

(56) References Cited

U.S. PATENT DOCUMENTS

| | | | | |
|---|---|---|---|---|
| 3,512,963 | A * | 5/1970 | Bieber et al. | 420/443 |
| 3,850,624 | A * | 11/1974 | Hulit et al. | 420/448 |
| 4,140,555 | A * | 2/1979 | Garcia et al. | 148/428 |
| 5,489,194 | A * | 2/1996 | Yoshinari et al. | 416/241 R |
| 6,918,972 | B2 * | 7/2005 | Ueta et al. | 148/428 |
| 2002/0020384 | A1 * | 2/2002 | Hoeg | C22C 19/05 123/188.3 |
| 2003/0150534 | A1 | 8/2003 | Frasier et al. | |
| 2004/0187973 | A1 * | 9/2004 | Takahata | F01D 5/28 148/428 |
| 2006/0051234 | A1 | 3/2006 | Pike, Jr. | |
| 2006/0222557 | A1 | 10/2006 | Pike, Jr. | |
| 2010/0166594 | A1 * | 7/2010 | Hirata | C21D 6/001 420/443 |

FOREIGN PATENT DOCUMENTS

| | | | | |
|---|---|---|---|---|
| CN | 1060890 | A | 5/1992 | |
| CN | 1831165 | A | 9/2006 | |
| EP | 0260511 | A2 | 3/1988 | |
| EP | 0387976 | A2 | 9/1990 | |
| EP | 1640465 | A2 | 3/2006 | |
| GB | 2 105 748 | * | 9/1981 | C22C 19/05 |
| JP | 51-084727 | A | 7/1976 | |
| JP | 5684436 | A | 7/1981 | |
| JP | 09-157779 | A | 6/1997 | |
| JP | 10-317080 | A | 12/1998 | |
| JP | 2002-180231 | A | 6/2002 | |
| JP | 2003-013161 | A | 1/2003 | |
| JP | 2004-538358 | A | 12/2004 | |
| JP | 2005-314728 | A | 11/2005 | |
| JP | 2006-070360 | A | 3/2006 | |
| JP | 2006-124776 | A | 5/2006 | |

OTHER PUBLICATIONS

Smialek, James L. "Oxidation resistance and critical sulfur content of single crystal superalloys." ASME 1996 International Gas Turbine and Aeroengine Congress and Exhibition. American Society of Mechanical Engineers, 1996.*

Huron, E. S., et al. "The influence of grain boundary elements on properties and microstructures of P/M nickel base superalloys." Superalloys 2004(2004): 73-81.*

International Search Report (PCT/ISA/210) dated Apr. 21, 2009 in corresponding PCT/JP2009/052426.

International Preliminary Examination Report (PCT/ISA/237) dated Apr. 21, 2009 in corresponding PCT/JP2009/052426.

Itoh, et al., "The Mechanism of Segregation Formation in Ni-base Superalloy Ingot," Nihon Seikosho Giho, No. 54, pp. 104-112 (1998).

Suzuki, et al., "Formation Condition of 'A' Segregation," Tetsu-To-Hagane, vol. 63, pp. 53-62 (1977).

Chinese Office Action dated Jul. 23, 2012 by the Chinese Patent Office for corresponding Chinese Application No. 200980105143.6.

Communication of Notice of Opposition, dated Aug. 27, 2013, issued by the European Patent Office in counterpart European Application No. 09711158.7.

Communication dated Sep. 18, 2015 issued by Patent Reexamination Board of the Chinese Patent Office in corresponding Chinese Application No. 200980105143.6.

* cited by examiner

*Primary Examiner* — Jessee Roe
(74) *Attorney, Agent, or Firm* — Sughrue Mion, PLLC

(57) ABSTRACT

A subject for the invention is to diminish the occurrence of streak-type segregation in producing a material comprising a Ni-based superalloy. The invention relates to a Ni-based superalloy having excellent unsusceptibility to segregation, characterized by comprising: 0.005 to 0.15 mass % of C; 8 to 22 mass % of Cr; 5 to 30 mass % of Co; equal or greater than 1 and less than 9 mass % of Mo; 5 to 21 mass % of W; 0.1 to 2.0 mass % of Al; 0.3 to 2.5 mass % of Ti; up to 0.015 mass % of B; and up to 0.01 mass % of Mg, with the remainder comprising Ni and unavoidable impurities.

10 Claims, 6 Drawing Sheets

COMPARATIVE MATERIAL (NO. B17)

INVENTION MATERIAL (NO. B3)

NI-BASED SUPERALLOY WITH EXCELLENT UNSUSCEPTIBILITY TO SEGREGATION

TECHNICAL FIELD

The present invention relates to a Ni-based superalloy which is suitable especially for the production of large ingots and is effective in diminishing the occurrence of streak-type segregation during the production of ingots.

BACKGROUND ART

From the standpoints of the necessity of reducing fossil-fuel consumption, prevention of global warming, etc., USC (ultra-supercritical pressure) plants are expected to be operated at an even higher efficiency. In particular, there recently is a strong trend toward high-efficiency coal-fired thermal power stations as 21st-century power plants. Turbine rotors, boiler members, and the like which are usable in next-generation electric-power generation with ultra-supercritical-pressure steam having a main-steam temperature exceeding 700° C. are being developed.

The related-art ferritic heat-resistant steels are no longer usable, from the standpoint of heat-resistance temperature, as heat resistance materials to be used as materials for turbine rotors exposed to steam having a high temperature exceeding 700° C. There is no way other than applying a Ni-based superalloy thereto.

Many of Ni-based superalloys are precipitation strengthening type alloys. In producing this type of alloy, a small amount of Ti or Al is added or a small amount of Nb is further added, and a precipitated phase constituted of $Ni_3$(Al, Ti), which is called a gamma prime phase (hereinafter expressed by γ'), and/or $Ni_3$(Al, Ti)Nb, which is called a gamma double-prime phase (expressed by γ"), is finely and coherently formed in the austenite (hereinafter expressed by γ) matrix to strengthen the system in order to obtain satisfactory high-temperature strength. Inconel (trademark; the same applies hereinafter) 706 and Inconel 718 belong to this type.

There also are alloys of the type in which the system is strengthened in a multiple manner by solid-solution strengthening and dispersion strengthening with $M_{23}C_6$ carbides besides precipitation strengthening with a γ' phase, such as Waspaloy, and so-called solid-solution strengthening type alloys which contain almost no precipitation-strengthening element and in which the system is strengthened by solid-solution strengthening with Mo and W. The latter type is represented by Inconel 230.

Recently, from the standpoint of the problem concerning a difference in thermal expansion between such an austenitic heat resistance alloy and ferritic steel members or the problem concerning thermal fatigue strength, precipitation strengthening type Ni-based alloys which have a low coefficient of thermal expansion equal to or better than that of ferritic heat-resistant steels and which, despite this, are superior in high-temperature material properties to the ferritic heat-resistant steels have also been proposed as disclosed in Patent Literature 1, Patent Literature 2, Patent Literature 3 and Patent Literature 4.

Patent Literature 1: JP-A-2005-314728
Patent Literature 2: JP-A-2003-13161
Patent Literature 3: JP-A-9-157779
Patent Literature 4: JP-A-2006-124776

DISCLOSURE OF THE INVENTION

Problems that the Invention is to Solve

On the other hand, in high-temperature environments in which the main-steam temperature exceeds 700° C., material properties are extremely sensitive also to the inhomogeneity of the product. The inhomogeneity of a material results in microsegregation and in the formation of nonmetallic inclusions and harmful intermetallic compounds to considerably reduce the material properties. Because of this, materials to be used in such environments are required to have high homogeneity.

In particular, W, which is added in Patent Literature 1, Patent Literature 2, Patent Literature 3 or Patent Literature 4, has the following drawback although effective in reducing the coefficient of thermal expansion and improving material properties. There is an extremely large difference in density between W and Ni, and this complexes the mechanism of solidification and is a major cause of acceleration of streak-type segregation, which is causative of various defects.

Furthermore, in the case of large ingots, macrosegregation is apt to occur because of a low solidification rate. When the alloy contains an element which accelerates the generation of segregation streaks, such as W, it is difficult to produce a large ingot of excellent quality usable as, e.g., a turbine rotor or casing.

The invention has been achieved in order to overcome the problems described above. The invention is effective in reducing the susceptibility to segregation of a Ni-based alloy containing W. By applying the invention, the occurrence of streak-type segregation can be diminished without considerably reducing material properties. A process for producing a large ingot of excellent quality which is reduced in segregation and suitable for use in producing large members can be provided.

Means for Solving the Problems

Precipitation-strengthening elements, such as Al, Ti, and Nb, and solid-solution-strengthening elements, such as Mo and W, to be added to a Ni-based alloy vary in the partition coefficient to solidification interfaces, depending on the combinations and contents thereof. Especially in the case of elements which differ considerably in density from Ni, the more the partition coefficient thereof is apart from 1, the more the difference in density between a matrix of molten metal and a concentrated part of the molten metal increase and the more the occurrence of streak-type segregation is accelerated. Consequently, for greatly improving the unsusceptibility to segregation of a W-containing Ni-based alloy, it is important that the partition coefficient of W, rather than that of Mo, which differs only slightly in density from Ni, or of Al, Ti, or Nb, which are added in a small amount, should be brought close to 1. This is because W is a solid-solution-strengthening element added in a relatively large amount and differs considerably in density from Ni.

It has generally been known that Co is an element which contributes as a solid-solution-strengthening element to high-temperature structure stability. However, the present inventors have found that by adding Co, not only the partition coefficients of Al, Ti, and Nb, which are precipitation-strengthening elements, but also the partition coefficient of W, which highly accelerates the generation of segregation streaks, can be brought close to 1 to thereby reduce the difference in density between the matrix of the molten metal and the concentrated part of the molten metal. As a result, it has become obvious that the occurrence of streak-type segregation in Ni-based superalloys containing W can be significantly reduced. The invention has been thus completed.

The invention accomplishes the object by the means shown below.

<1> A Ni-based superalloy having excellent unsusceptibility to segregation, characterized by containing: 0.005 to 0.15 mass % of C; 8 to 22 mass % of Cr; 5 to 30 mass % of Co; equal to or greater than 1 and less than 9 mass % of Mo; 5 to 21 mass % of W; 0.1 to 2.0 mass % of Al; 0.3 to 2.5 mass % of Ti; up to 0.015 mass % of B; and up to 0.01 mass % of Mg, with the remainder comprising Ni and unavoidable impurities.

<2> The Ni-based superalloy having excellent unsusceptibility to segregation according to <1> characterized by further containing one or the two of up to 0.2 mass % of Zr and up to 0.8 mass % of Hf.

<3> The Ni-based superalloy having excellent unsusceptibility to segregation according to <1> or <2> characterized by further containing one or the two of Nb and Ta in such a total amount as to result in Nb+½Ta≤1.5 mass %.

<4> The Ni-based superalloy having excellent unsusceptibility to segregation according to any one of <1> to <3> characterized by the Ni-based superalloy being for use as a material for a forging as a generator member or for a casting as a generator member.

The Ni-based superalloy having excellent unsusceptibility to segregation of the invention produces the following effects. The partition coefficient to solidification interfaces of W, which differs considerably in density from Ni, can be brought close to 1 while maintaining material properties, and the difference in density between the matrix of the molten metal and the concentrated part of the molten metal can be reduced. As a result, the occurrence of streak-type segregation can be diminished, and a large ingot of excellent quality which is reduced in segregation and suitable for use in producing large members can be produced.

BEST MODE FOR CARRYING OUT THE INVENTION

Figure 1:
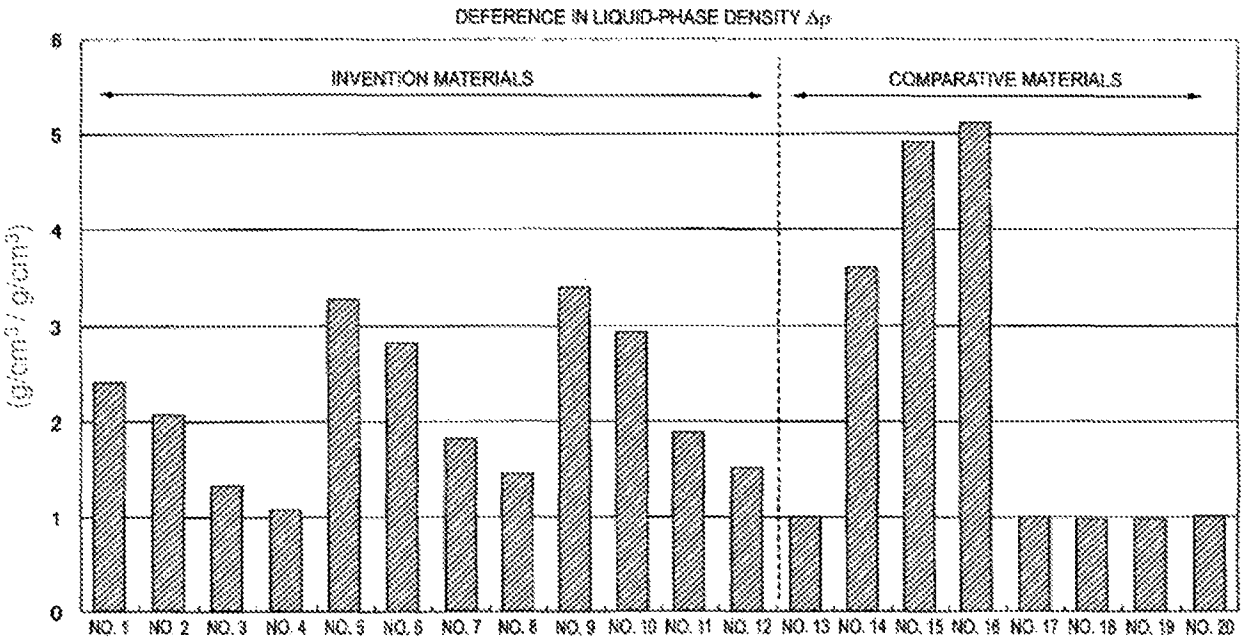
FIG. 1 A graph showing the results of the relative evaluation of test materials for difference in liquid-phase density in Example.

One embodiment of the invention will be explained below.

<Composition of the Alloy>

Reasons for the limitation of the alloy composition of the invention will be explained below.

In the following explanations, all values of content are given in terms of % by mass or ppm by mass.

C: 0.005 to 0.15%

C combines with Ti to form TiC, and combines with Cr and No to form carbides of the $M_6C$, $M_7C_3$, and $M_{23}C_6$ types. C inhibits alloy crystal grains from enlarging and contributes also to an improvement in high-temperature strength. Furthermore, the $M_6C$ and $M_{23}C$ carbides are precipitated in a proper amount at grain boundaries to thereby strengthen the grain boundaries. Because of these, C is an essential element in the invention. When C is contained in an amount of 0.005% or larger, those effects are obtained. When the content of C is 0.15% or less, a Ti amount necessary for precipitation strengthening can be ensured and the amount of Cr carbides which precipitate at grain boundaries during an aging treatment can be reduced. The alloy hence does not suffer grain-boundary embrittlement and can retain ductility. Consequently, the amount of C to be added is limited to the range of from 0.005 to 0.15%. For the same reason, it is preferable that the lower limit and the upper limit thereof should be 0.01% and 0.08%, respectively.

Cr: 8 to 22%

Cr is an element which is indispensable for enhancing the oxidation resistance, corrosion resistance, and strength of the alloy. Furthermore, Cr combines with C to precipitate as carbides and thereby increase high-temperature strength.

From the standpoint of causing Cr to produce these effects, the content of Cr must be at least 8%. However, too high contents thereof reduce the stability of the matrix and promote the formation of harmful TCP phases such as a σ phase and α-Cr, resulting in adverse influences on ductility and toughness.

Consequently, the content of Cr is limited to the range of from 8 to 22%. For the same reason, it is preferable that the lower limit and the upper limit thereof should be 10% and 15%, respectively. The upper limit thereof is more preferably 13%.

Co: 5 to 30%

Co in the invention is an essential element for bringing the partition coefficient of W close to 1 and thereby greatly improving unsuceptibility to segregation, W considerably differing from Ni in density and being a cause of the occurrence of streak-type segregation. Co is effective also in bringing the partition coefficients of precipitation-strengthening elements, such as Al, Ti, and Nb, close to 1. When the alloy contains Co in an amount of 5% or larger, those effects are sufficiently obtained. When the content thereof is 30% or less, satisfactory forgeability can be maintained and the TCP phase called a μ phase (Laves phase) is less apt to generate. This alloy can hence have a stable matrix structure at high temperatures and retain satisfactory high-temperature structure stability. Consequently, the content of Co is limited to the range of from 5 to 30%. For the same reason, it is preferable that the lower limit and the upper limit thereof should be 10% and 20%, respectively.

Mo: Equal to or Greater than 1% and Less than 9%

Mo not only is effective as a solid-solution-strengthening element which forms a solid solution mainly in the matrix to strengthen the matrix itself, but also forms a solid solution in the γ' phase and replaces Al present at Al sites of the γ' phase to thereby enhance the stability of the γ' phase. Mo is hence effective in heightening high-temperature strength and in enhancing the stability of the structure. When the content of Mo is 1% or greater, these effects are sufficiently obtained. When the content thereof is less than 9%, the TCP phase called a μ phase (Laves phase) is less apt to generate. This alloy can hence have a stable matrix structure at high temperatures and retain satisfactory high-temperature structure stability. Consequently, the content of Mo is limited to the range of from equal to or greater than 1% and less than 9%. For the same reason, it is preferable that the lower limit and the upper limit thereof should be 3.0% and 7.0%, respectively.

W: 5 to 21%

Like Mo, W not only is effective as a solid-solution-strengthening element which forms a solid solution in the matrix to strengthen the matrix itself, but also forms a solid solution in the γ' phase and replaces Al present at Al sites of the γ' phase to thereby enhance the stability of the γ' phase. W is hence effective in heightening high-temperature strength and in enhancing the stability of the structure. W further has the effect of lowering the coefficient of thermal expansion. So long as W is contained in a proper amount, no TCP-phase precipitation occurs and, hence, structure stability is not impaired. However, too high contents thereof result in the precipitation of α-W, and this not only reduces structure stability but also considerably impairs hot workability. Consequently, the content of W is limited to the range of from 5 to 21%. For the same reason, it is preferable that the lower limit and the upper limit thereof should be 7.0% and 15.0%, respectively.

Al: 0.1 to 2.0%

Al combines with Ni to precipitate a γ' phase and thereby contributes to alloy strengthening. In case where the content of Al is less than 0.1%, sufficient precipitation strengthening cannot be obtained. Too high contents thereof cause coarse γ'-phase aggregates to generate at grain boundaries, and this results in concentrated regions and a precipitate-free area, leading to a decrease in high-temperature properties and deterioration of notch sensitivity. Mechanical properties hence decrease considerably. In addition, excessively high contents thereof result in a decrease in hot workability and poor forgeability. Consequently, the content of Al is limited to the range of from 0.1 to 2.0%. For the same reason, it is preferable that the lower limit and the upper limit thereof should be 0.5% and 1.5%, respectively.

Ti: 0.3 to 2.5%

Ti not only mainly serves to form MC carbides and inhibit alloy crystal grains from enlarging, but also combines, like Al, with Ni to precipitate a γ' phase and thereby contribute to alloy strengthening. From the standpoint of sufficiently obtaining this function, Ti must be contained in an amount of 0.3% or larger. However, too high contents thereof reduce the high-temperature stability of the γ' phase and cause the precipitation of an Ti phase, resulting in decreases in strength, ductility, toughness, and long-term structure stability. Consequently, the content of Ti is limited to the range of from 0.3 to 2.5%. For the same reason, it is preferable that the lower limit and the upper limit thereof should be 0.5% and 2.0%, respectively.

$Nb+\frac{1}{2}Ta \leq 1.5\%$

Nb and Ta are precipitation-strengthening elements like Al and Ti, and precipitate a γ" phase to contribute to alloy strengthening. Nb and Ta are hence incorporated according to need. However, incorporation thereof in a large amount tends to result in the precipitation of intermetallic compounds such as a Laves phase and a σ phase, and this considerably impairs structure stability. Consequently, the content of Nb and Ta, which are incorporated according to need, is 1.5% or less in terms of the value of $Nb+\frac{1}{2}Ta$.

For the same reason as described above, it is preferable that the upper limit of the content thereof should be 1.0% or less in terms of the value of $Nb+\frac{1}{2}Ta$. From the standpoint of sufficiently obtaining that function, the value of $Nb+\frac{1}{2}Ta$ is preferably 0.1% or greater, more preferably 0.2% or greater.

B: 0.015% or Less

B segregates at grain boundaries to contribute to high-temperature properties. B is hence incorporated according to need. However, incorporation thereof in too large an amount tends to result in the formation of borides, and this results in grain-boundary embrittlement, rather than strengthening.

Consequently, the content of B, which is incorporated according to need, is 0.015% or less. From the standpoint of sufficiently obtaining that function, it is preferable that the alloy should contain B in an amount of 0.0005% or larger. For the same reason as described above, the upper limit of the content thereof is preferably 0.01%.

Zr: 0.2% or Less

Zr segregates at grain boundaries to contribute to high-temperature properties, like B. Zr is hence incorporated according to need. However, incorporation thereof in too large an amount reduces the hot workability of the alloy. Consequently, the content of Zr, which is incorporated according to need, is 0.2% or less. From the standpoint of sufficiently obtaining that function, it is preferable that the alloy should contain Zr in an amount of 0.001% or larger, more preferably in an amount of 0.02% or larger. For the same reason as described above, the upper limit of the content thereof is preferably 0.08%.

Hf: 0.8% or Less

Hf segregates at grain boundaries to contribute to high-temperature properties, like B and Zr. Hf is hence incorporated according to need. However, incorporation thereof in too large an amount reduces the hot workability of the alloy.

Consequently, the content of Hf, which is incorporated according to need, is 0.8% or less. From the standpoint of sufficiently obtaining that function, it is preferable that the alloy should contain Hf in an amount of 0.05% or larger, more preferably in an amount of 0.1% or larger. For the same reason as described above, the upper limit of the content thereof is preferably 0.5%.

Mg: 0.01% or Less

Mg has the effect of mainly combining with S to form a sulfide and enhance hot workability. Mg is hence incorporated according to need. However, incorporation thereof in too large an amount results in grain-boundary embrittlement, rather than strengthening, and considerably reduces hot workability. Consequently, the content of Mg is limited to the range of up to 0.01%. From the standpoint of sufficiently obtaining that function, it is preferable that the content of Mg should be 0.0005% or greater.

Remainder: Ni and Unavoidable Impurities

The remainder of the Ni-based alloy of the invention comprises Ni and unavoidable impurities. Examples of the unavoidable impurities include Si, Mn, P, S, O and N. The allowable contents of the respective unavoidable impurities are preferably as follows: Si: up to 0.3%, Mn: up to 0.2%, P: up to 0.01%, S: up to 0.005%, O: up to 30 ppm and N: up to 60 ppm.

Too high Si contents reduce the ductility of the alloy and impair the unsusceptibility thereof to segregation. Consequently, it is preferable to limit the content of Si to 0.3% or less. The content thereof is more preferably less than 0.1%, even more preferably less than 0.05%.

<Process for Production>

The Ni-based alloy of the invention in the form of an ingot can be produced by ordinary methods, and such processes for production are not particularly limited. It is, however, preferable that the alloy of the invention should contain impurities such as Si, Mn, P, S, O and N in smallest possible amounts. Consequently, it is preferable to employ a suitable melting method such as, e.g., the so-called double melting method in which VIM and ESR processes are used or the so-called triple melting method in which VIM, ESR, and VAR processes are used.

The Ni-based alloy ingot produced is usually subjected to hot forging to thereby break the cast structure, eliminate internal voids through press bonding, and diffuse segregated components. In the invention, conditions for the hot forging are not particularly limited and the hot forging can be conducted, for example, in an ordinary manner.

After the hot forging, the alloy is heated to or above the recrystallization temperature to conduct a solution treatment. This solution treatment can be performed at a temperature of, for example, 1,000-1,250° C. With respect to the time period of the solution treatment, a suitable period may be set according to the size and shape of the material, etc. A known heating furnace can be used to conduct the solution treatment, and methods of heating and heating apparatus are not particularly limited in the invention. After the solution treatment, the alloy is cooled by, e.g., air cooling.

After the solution treatment, a first aging treatment is conducted using a known heating furnace or the like. This aging treatment is performed at a temperature of 700° C.-1,000° C. With respect to heating to the aging-treatment temperature, the heating rate is not particularly limited in the invention.

After the first aging treatment, a second aging treatment is conducted. The first and second aging treatments may be performed successively. Alternatively, the second aging treatment may be performed after the alloy is temporarily brought to room temperature. For the second aging treatment to be conducted after the alloy is brought to the room temperature, the same heating furnace or the like may be used or another heating furnace or the like can be used.

It is preferable that during the period from the first aging treatment to the second aging treatment, the alloy should be cooled by furnace cooling, fan cooling, or the like and successively subjected to the second aging treatment. The cooling rate is preferably 20° C./hr or higher.

The cooling rate after the second aging treatment is not particularly limited, and the alloy may be allowed to cool in air or can be cooled by forced cooling, etc. Although the first and second aging treatments in the process of the invention may be conducted in the manners described above, this is not intended to exclude any subsequent aging treatment. A third and subsequent aging treatments can be performed according to need.

EXAMPLE

One embodiment of the invention is explained next.

About 100 g of each of the test materials respectively having the chemical compositions shown in Table 1 was subjected to the same unidirectional solidification test as the test described in a document (*Nihon Seikōsho Gihō*, No. 54 (1998.8), "Mechanism of Segregation in Ni-based Superalloy", p. 106) to unidirectionally solidify the material from the bottom. Namely, this test was conducted using a vertical electric resistance furnace. This test furnace includes a furnace body equipped with a heating element, and the furnace body has an elevator so that the vertical position of the furnace body can be changed during the test. In the test, about 100 g of each test material was placed in a Tammann tube, and this tube was set so that the surface of the test material in a molten state was located in a lowermost area of the sorking zone. Namely, the test material was disposed so as to have a temperature gradient in the vertical direction. A temperature was set so that the test material was sufficiently melted even in the lowermost part of the crucible where the test material had a lowest temperature. The test material was heated in the furnace body in an argon atmosphere (flow rate, 500 cc/min). After it was ascertained that the whole test material had been melted, the controlled temperature was lowered by about 50° C. and the furnace body was elevated by 20-30 mm at a rate of about 1 mm/min. This operation brought a lower part of the test material out of the sorking zone to unidirectionally solidify the test material upward from the lower side. Immediately after completion of the elevation, the furnace body was lowered by 5 mm at the same rate as in the elevation in order to obtain a smooth interface at the solidification front. After completion of the lowering, the lid of the furnace was opened and the test material was taken out together with the crucible and immediately introduced into water to cause quench solidification.

The test material obtained was vertically cut, and the cut surfaces were etched to ascertain interfaces. Thereafter, this test material was subjected to EPMA line analysis to determine the concentrations of the solid-phase part and liquid-phase part, and values of equilibrium partition coefficient were calculated. The densities of the matrix of the molten metal and that of the concentrated part of the molten metal were calculated from the values of equilibrium partition coefficient obtained, and the difference in density $\Delta\rho$ between the molten metal matrix and the molten metal concentrated part was determined. The difference in density $\Delta\rho$ between the molten metal matrix and the molten metal concentrated part indicates the tendency of the alloy to segregate. The smaller the value of $\Delta\rho$, the less the alloy segregates. The values of $\Delta\rho$ thus determined were compared, with the value for comparative material No. 13 being taken as 1. The results of this comparative evaluation are shown in FIG. 1.

The following are apparent from FIG. 1. In comparative materials (No. 13 to No. 16), the difference in density between the molten metal matrix and the molten metal concentrated part increased as the amount of W was increased. In the invention materials (No. 1 to No. 12), however, the value of $\Delta\rho$ decreased, regardless of W content, as the amount of Co was increased. On the other hand, the comparative materials (No. 17 to No. 20) obtained by adding Co to a W-free comparative material (No. 13) had almost the same value of $\Delta\rho$. Namely, it has become obvious that by adding Co to a W-containing Ni-based superalloy, the value of $\Delta\rho$ can be reduced and the alloy can be caused to be less apt to segregate.

TABLE 1

| Test material No. | | C | Si | Mn | P | S | Cr | Mo | W | Co | Al | Ti | Nb | Ta | B | Zr | Hf | Mg |
|---|---|---|---|---|---|---|---|---|---|---|---|---|---|---|---|---|---|---|
| Invention material | 1 | 0.030 | 0.01 | <.01 | <.005 | 0.0015 | 13.0 | 8.2 | 5.0 | 5.1 | 1.3 | 0.8 | — | — | 0.0011 | 0.010 | — | 0.0005 |
| | 2 | 0.025 | 0.01 | <.01 | <.005 | 0.0013 | 12.8 | 8.1 | 5.1 | 10.2 | 1.2 | 0.7 | — | — | 0.0012 | — | 0.16 | 0.0006 |
| | 3 | 0.028 | 0.01 | <.01 | <.005 | 0.0014 | 12.7 | 8.3 | 5.0 | 20.4 | 1.3 | 0.7 | — | — | 0.0013 | 0.032 | — | 0.0012 |
| | 4 | 0.015 | 0.01 | <.01 | <.005 | 0.0014 | 12.9 | 8.2 | 5.0 | 29.8 | 1.2 | 0.9 | — | 0.6 | 0.0015 | 0.020 | 0.11 | 0.0009 |
| | 5 | 0.026 | 0.02 | <.01 | <.005 | 0.0011 | 11.7 | 4.0 | 10.1 | 5.1 | 0.8 | 1.5 | 0.3 | — | 0.0022 | 0.021 | — | 0.0011 |
| | 6 | 0.023 | 0.02 | <.01 | <.005 | 0.0012 | 11.8 | 4.1 | 10.1 | 10.2 | 0.9 | 1.4 | — | — | 0.0023 | 0.040 | — | 0.0013 |
| | 7 | 0.016 | 0.02 | <.01 | <.005 | 0.0011 | 11.8 | 4.1 | 10.0 | 20.4 | 0.8 | 1.5 | — | — | 0.0024 | 0.021 | 0.10 | 0.0013 |
| | 8 | 0.030 | 0.02 | <.01 | <.005 | 0.0010 | 11.6 | 4.0 | 10.2 | 30.0 | 0.8 | 1.5 | — | — | 0.0019 | 0.030 | — | 0.0012 |
| | 9 | 0.030 | 0.02 | <.01 | <.005 | 0.0010 | 10.2 | 4.2 | 20.2 | 5.1 | 0.6 | 1.7 | — | 0.4 | 0.0016 | 0.049 | — | 0.0015 |
| | 10 | 0.032 | 0.02 | <.01 | <.005 | 0.0011 | 11.6 | 3.5 | 20.3 | 10.2 | 1.0 | 1.2 | — | — | 0.0015 | 0.031 | — | 0.0010 |
| | 11 | 0.031 | 0.02 | <.01 | <.005 | 0.0010 | 10.8 | 3.4 | 20.1 | 20.4 | 1.1 | 1.3 | 0.3 | — | 0.0021 | — | 0.16 | 0.0012 |
| | 12 | 0.031 | 0.02 | <.01 | <.005 | 0.0011 | 12.1 | 3.8 | 20.0 | 29.9 | 1.3 | 1.2 | — | — | 0.0028 | 0.038 | — | 0.0006 |
| Comparative material | 13 | 0.035 | 0.01 | <.01 | <.005 | 0.0010 | 12.7 | 8.2 | — | — | 0.8 | 1.4 | — | — | 0.0015 | 0.015 | — | 0.0030 |
| | 14 | 0.015 | 0.01 | <.01 | <.005 | 0.0012 | 12.8 | 8.0 | 5.1 | — | 1.3 | 0.8 | — | — | 0.0012 | 0.030 | — | 0.0005 |
| | 15 | 0.033 | 0.02 | <.01 | <.005 | 0.0011 | 12.7 | 4.0 | 10.0 | — | 0.8 | 1.4 | 0.3 | — | 0.0025 | 0.035 | — | 0.0010 |
| | 16 | 0.032 | 0.02 | <.01 | <.005 | 0.0015 | 12.6 | 4.1 | 20.0 | — | 1.0 | 1.2 | — | — | 0.0016 | — | — | 0.0020 |
| | 17 | 0.029 | 0.01 | <.01 | <.005 | 0.0010 | 11.7 | 4.0 | — | 5.1 | 0.8 | 1.5 | — | — | 0.0015 | 0.035 | — | 0.0031 |
| | 18 | 0.030 | 0.01 | <.01 | <.005 | 0.0014 | 11.7 | 4.0 | — | 10.2 | 0.9 | 1.4 | — | — | 0.0017 | 0.032 | — | 0.0015 |
| | 19 | 0.031 | 0.01 | <.01 | <.005 | 0.0013 | 11.7 | 4.1 | — | 20.4 | 0.8 | 1.4 | — | 0.2 | 0.0026 | 0.034 | — | 0.0006 |
| | 20 | 0.041 | 0.01 | <.01 | <.005 | 0.0010 | 11.7 | 4.0 | — | 30.0 | 0.8 | 1.4 | — | — | 0.0028 | 0.035 | — | 0.0021 |

Subsequently, a macrosegregation test was conducted using a horizontal furnace for unidirectional solidification in the same manner as in the document (*Nihon Seikōsho Gihō*, No. 54 (1998.8), "Mechanism of Segregation in Ni-based Superalloy", p. 105) to experimentally compare in the tendency to undergo streak-type segregation. This horizontal unidirectional solidification test is a most basic experimental method for simulating the solidification conditions employed in an actual apparatus and experimentally reproducing streak-type segregation.

This horizontal furnace for unidirectional solidification includes a rectangular siliconit resistance furnace, a rectangular double crucible made of alumina, and a cooling element. In this furnace, solidification can be caused to proceed from a lateral side at a constant rate with compressed air for cooling. In order that the segregation occurring in large steel ingots might occur in a small steel ingot, it is necessary to use a reduced solidification rate in obtaining the steel ingot. In this apparatus, the solidification conditions employed in producing large steel ingots can be reproduced by regulating the amount of cooling air and the temperature for holding steel in the furnace.

Figure 2:
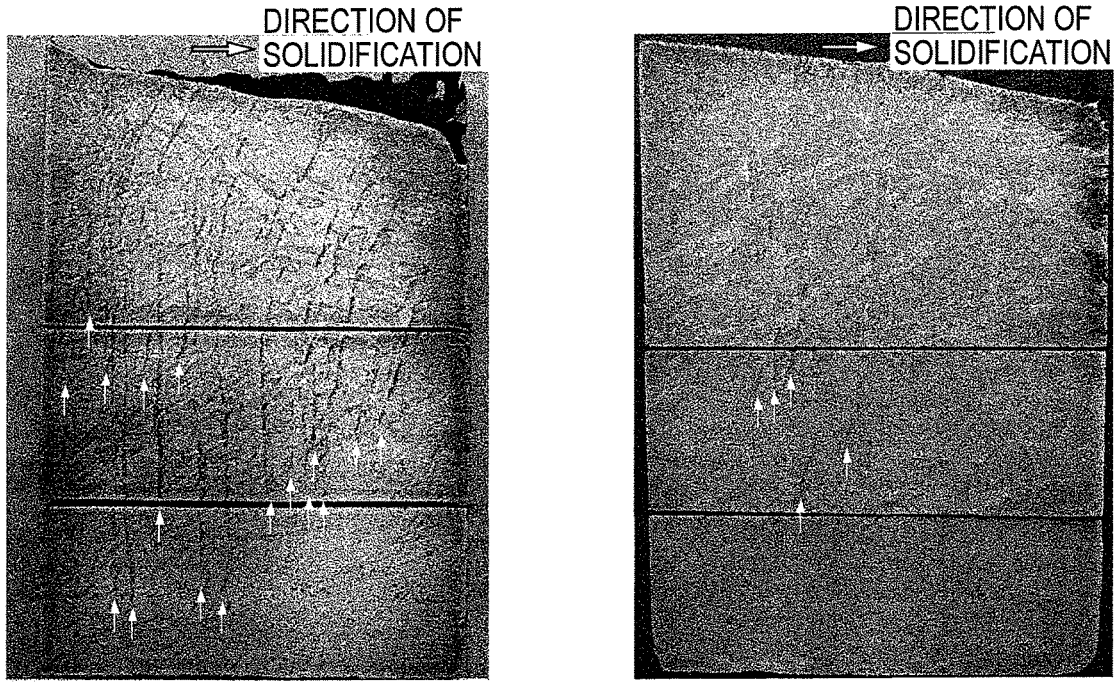
FIG. 2 Photographs (magnification: 0.4 diameters) as substitutes for drawings, the photographs showing metallographic structures among the results of the macrosegregation test of a comparative material (No. B17) and an invention material (No. B3) in Example.

In the test, 14 kg of each of Ni-based alloys respectively having the compositions shown in Table 2 (No. B1 to No. B9, No. B17 to No. B20, No. B22, and No. B23, in which the remainder is Ni and unavoidable impurities) was melted and cast into the rectangular crucible made of alumina. Immediately thereafter, compressed air was passed through the cooling element disposed in a lateral side of the crucible to unidirectionally solidify the melt in a horizontal direction from the lateral side having the cooling element. Thus, test materials were produced. In FIG. 2 are shown the results of the macrosegregation test of a comparative material (No. B17) and an invention material (No. B3) as examples. The arrows in the figure indicate the positions of segregation streaks developed in the casts.

TABLE 2

| Test material No. | | C | Si | Mn | P | S | Cr | Mo | W | Co | Al | Ti | Nb | Ta | B | Zr | Hf | Mg |
|---|---|---|---|---|---|---|---|---|---|---|---|---|---|---|---|---|---|---|
| Invention material | B1 | 0.039 | 0.01 | <.01 | <.005 | 0.0008 | 12.8 | 4.1 | 10.0 | 5.0 | 0.6 | 1.4 | 0.3 | — | 0.0010 | 0.032 | — | 0.0012 |
| | B2 | 0.040 | 0.01 | <.01 | <.005 | 0.0011 | 12.0 | 4.0 | 10.2 | 10.1 | 1.4 | 1.0 | — | 0.4 | 0.0010 | 0.029 | — | 0.0012 |
| | B3 | 0.039 | 0.01 | <.01 | <.005 | 0.0010 | 11.8 | 4.0 | 10.1 | 22.3 | 0.8 | 1.5 | — | 0.6 | 0.0012 | 0.031 | — | 0.0013 |
| | B4 | 0.035 | 0.01 | <.01 | <.005 | 0.0009 | 12.5 | 4.2 | 10.1 | 29.8 | 1.5 | 1.2 | — | — | 0.0013 | 0.025 | — | 0.0022 |
| | B5 | 0.030 | 0.01 | 0.51 | <.005 | 0.0008 | 11.5 | 2.0 | 14.0 | 20.2 | 0.6 | 1.2 | — | — | 0.0029 | — | — | 0.0011 |
| | B6 | 0.035 | 0.01 | <.01 | <.005 | 0.0009 | 10.6 | 7.0 | 7.1 | 11.2 | 0.8 | 1.5 | — | — | 0.0010 | 0.030 | — | 0.0012 |
| | B7 | 0.034 | 0.01 | <.01 | <.005 | 0.0009 | 10.9 | 7.1 | 7.0 | 20.2 | 0.8 | 1.6 | — | — | 0.0010 | 0.028 | — | 0.0020 |
| | B8 | 0.032 | 0.01 | <.01 | <.005 | 0.0010 | 20.2 | 4.0 | 10.0 | 10.2 | 1.4 | 0.4 | 0.6 | — | 0.0012 | 0.030 | — | 0.0014 |
| | B9 | 0.030 | 0.01 | <.01 | <.005 | 0.0011 | 20.1 | 4.0 | 10.0 | 20.0 | 1.4 | 0.4 | 0.6 | — | 0.0010 | 0.029 | — | 0.0016 |
| | B10 | 0.032 | 0.01 | <.01 | <.005 | 0.0009 | 12.1 | 4.1 | 10.1 | 10.2 | 0.8 | 1.5 | — | — | 0.0010 | 0.029 | — | 0.0012 |
| | B11 | 0.030 | 0.01 | <.01 | <.005 | 0.0010 | 12.0 | 4.0 | 10.1 | 16.1 | 0.8 | 1.5 | — | — | 0.0010 | 0.031 | — | 0.0011 |
| | B12 | 0.031 | 0.01 | <.01 | <.005 | 0.0011 | 12.1 | 3.9 | 10.2 | 21.3 | 0.8 | 1.5 | — | — | 0.0009 | — | 0.15 | 0.0012 |
| | B13 | 0.035 | 0.01 | <.01 | <.005 | 0.0012 | 12.0 | 4.0 | 10.0 | 16.2 | 0.8 | 1.5 | 0.3 | — | 0.0012 | 0.038 | — | 0.0018 |
| | B14 | 0.032 | 0.01 | <.01 | <.005 | 0.0010 | 12.1 | 3.9 | 10.1 | 16.1 | 0.8 | 1.5 | 0.1 | 0.4 | 0.0010 | 0.036 | — | 0.0017 |
| | B15 | 0.032 | 0.01 | <.01 | <.005 | 0.0010 | 12.0 | 7.1 | 7.0 | 10.2 | 0.8 | 1.2 | — | — | 0.0010 | 0.029 | — | 0.0015 |
| | B16 | 0.030 | 0.01 | <.01 | <.005 | 0.0010 | 12.1 | 7.0 | 7.0 | 20.2 | 0.8 | 1.2 | — | — | 0.0011 | 0.020 | 0.10 | 0.0009 |

TABLE 2-continued

| Test material No. | | C | Si | Mn | P | S | Cr | Mo | W | Co | Al | Ti | Nb | Ta | B | Zr | Hf | Mg |
|---|---|---|---|---|---|---|---|---|---|---|---|---|---|---|---|---|---|---|
| Comparative material | B17 | 0.035 | 0.01 | <.01 | <.005 | 0.0009 | 12.1 | 4.1 | 10.0 | — | 0.8 | 1.5 | — | — | 0.0007 | 0.035 | — | 0.0010 |
| | B18 | 0.030 | 0.01 | 0.57 | <.005 | 0.0010 | 12.1 | 2.0 | 14.0 | — | 0.3 | 1.2 | — | — | 0.0029 | — | — | 0.0009 |
| | B19 | 0.035 | 0.01 | <.01 | <.005 | 0.0009 | 12.1 | 7.2 | 7.0 | — | 0.8 | 1.5 | — | — | 0.0010 | 0.030 | — | 0.0012 |
| | B20 | 0.033 | 0.01 | <.01 | <.005 | 0.0010 | 20.2 | 4.0 | 10.0 | — | 1.4 | 0.4 | 0.6 | — | 0.0012 | 0.031 | — | 0.0015 |
| | B21 | 0.035 | 0.01 | <.01 | <.005 | 0.0009 | 12.1 | 7.1 | 7.0 | — | 0.8 | 1.2 | — | — | 0.0010 | — | — | 0.0012 |
| | B22 | 0.040 | 0.01 | <.01 | <.005 | 0.0010 | 12.1 | 4.0 | — | — | 1.5 | 0.8 | — | — | 0.0015 | 0.040 | — | 0.0021 |
| | B23 | 0.040 | 0.01 | <.01 | <.005 | 0.0011 | 12.1 | 4.0 | — | 21.0 | 0.8 | 1.5 | — | — | 0.0015 | 0.034 | — | 0.0011 |
| | B24 | 0.030 | 0.01 | <.01 | <.005 | 0.0010 | 12.1 | 4.1 | 10.0 | 35.0 | 0.9 | 1.5 | — | — | 0.0010 | 0.030 | — | 0.0009 |

(Remainder: Ni and unavoidable impurities; wt %)

As apparent from FIG. 2, the ingot of the comparative material (No. B17) had many distinct segregation streaks. On the other hand, the invention material (No. B3) had a far smaller number of segregation streaks than the comparative material, and was ascertained to have been greatly improved in unsusceptibility to segregation.

Furthermore, critical values for segregation $\alpha$ were calculated from the results of the horizontal unidirectional solidification test of the test materials, and the test materials were quantitatively compared in the tendency to undergo streak-type segregation. As described in a document (*Tetsu-To-Hagane*, Vol. 63, Year (1977), No. 1, "Formation Condition of "A" Segregation", pp. 53-62), a critical value for segregation $\alpha$ is given by the requirement $\epsilon \cdot R^{1.1} \leq \alpha$ from the relationship between the cooling rate $\epsilon$ (° C./min) and the solidification rate R (mm/min) both measured at the solidification front. The value of $\alpha$ varies from alloy to alloy. Namely, streak-type segregation is considerably influenced by two factors in thermal condition, i.e., the cooling rate and the solidification rate both measured at the solidification front. It has been experimentally demonstrated that streak-type segregation does not occur when the critical value for segregation $\alpha$ satisfies the requirement $\epsilon \cdot R^{1.1} \leq \alpha$.

In the horizontal furnace for unidirectional solidification used in this test, each test material can be examined for temperature drop curve with six thermocouples disposed in the furnace. From this temperature drop curve was calculated the cooling rate $\epsilon$ (° C./min) of the solidification front having a temperature corresponding to a solid fraction of 0.3 and located in the position where streak-type segregation occurred. Likewise, the solidification rate R (ram/min) was calculated from the position where streak-type segregation occurred and the time at which the temperature dropped to the value corresponding to a solid fraction of 0.3, and the critical value for segregation $\alpha$ of each test material was determined.

Incidentally, the solid fraction of 0.3 used in the calculation is a value corresponding to the boundary between that part in a solid/liquid coexistence layer which has a dendrite network and the part in which dendrite has not sufficiently grown and has not come into a network state; this boundary is presumed to be the position where streak-type segregation occurs.

Figure 3:
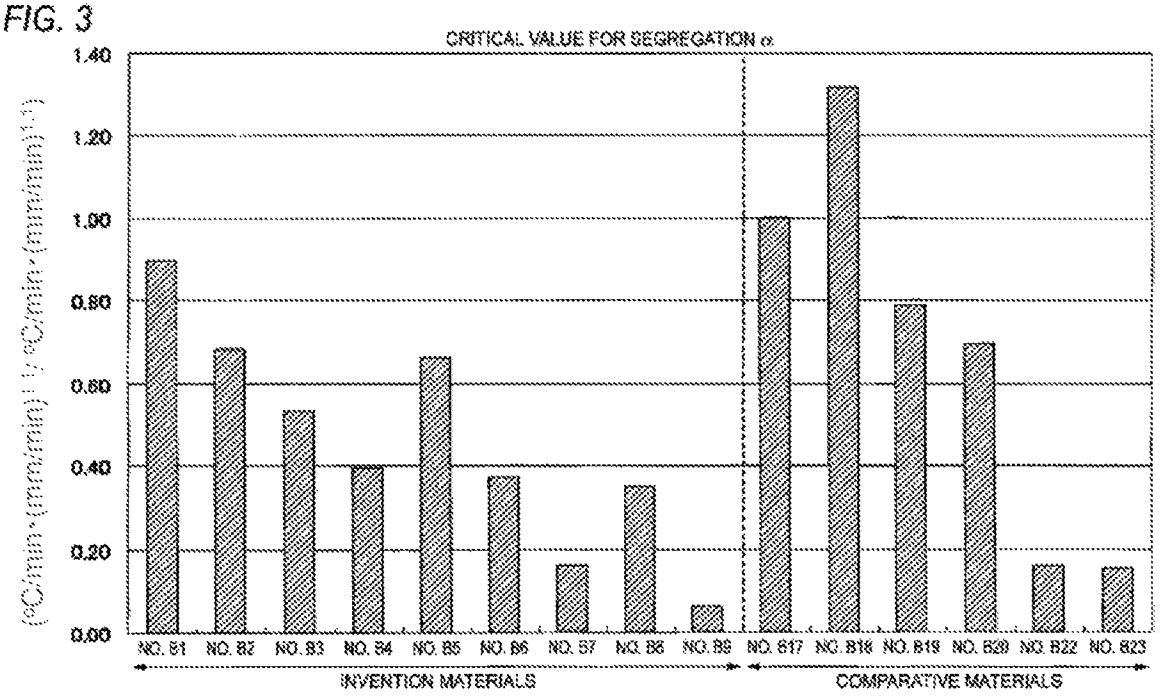
FIG. 3 A graph showing the results of the relative evaluation of test materials for critical value for segregation in Example.

In FIG. 3 are shown the results of comparative evaluation in which the critical values for segregation $\alpha$ of the test materials were compared, with the value of comparative material No. B17 being taken as 1. As apparent from FIG. 3, invention materials (No. B1 to No. B4) decreased in $\alpha$ with increasing Co addition amount as compared with the comparative material (No. B17). These invention materials were ascertained to have improved unsusceptibility to segregation. Furthermore, the invention material (No. B5) obtained by adding 20% Co to a comparative material (No. B18) and the invention materials (No. B6 and No. B7; and No. B8 and No. B9) obtained by adding Co to comparative materials (No. B19; and No. B20) also had a reduced value of $\alpha$. The test results show that these invention materials had improved unsusceptibility to segregation. On the other hand, in the comparative material (No. B23) obtained by adding Co to a W-free comparative material (No. B22), almost no decrease in $\alpha$ was observed. Namely, it has become obvious that in the case of the W-containing alloys only, the critical value for segregation can be reduced and the inhibition of streak-type segregation can be enhanced with increasing Co addition amount.

Subsequently, test materials shown in Table 2 (No. B10 to No. B17, No. B21, and No. B24) were melted with a vacuum induction melting furnace (VIM) and formed into 50-kg ingots. The resultant test ingots were subjected to a diffusion treatment and then to hot forging into a plate material having a thickness of 30 mm. In this operation, test materials (No. B10 to No. B17 and No. B21) were able to be formed into a plate material having a thickness of 30 mm by the hot forging, whereas a comparative material (No. B24) showed poor hot forgeability and developed a large crack during the forging. The forging of this material was hence stopped. The test materials forged into a plate material were separately subjected to a solution treatment at a temperature not lower than the recrystallization temperature and then cooled with air to temporarily bring the test materials into room temperature. Thereafter, the test materials were subjected to a heat treatment, as a first aging treatment, under the conditions of 840° C. and 10 hours, subsequently cooled by furnace cooling (cooling rate, 50° C./h), and successively subjected to a second aging treatment. In the second aging treatment, the heat treatment was conducted under the conditions of 750° C. and 24 hours. Thereafter, the plate materials were cooled by furnace cooling (cooling rate, 50° C./h) to obtain test materials.

Figure 5:
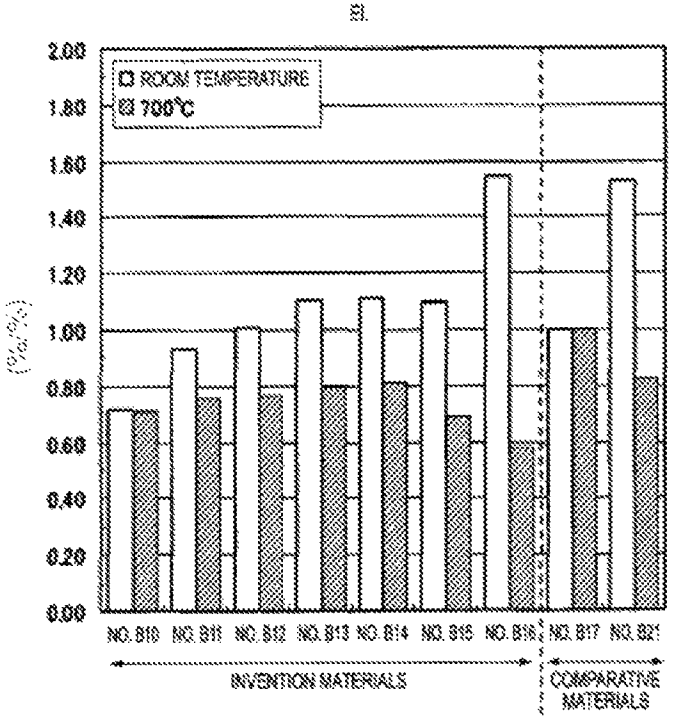
FIG. 5 A graph showing the elongations (El.) at room temperature and a high temperature (700° C.) of test materials in Example.
Figure 4:
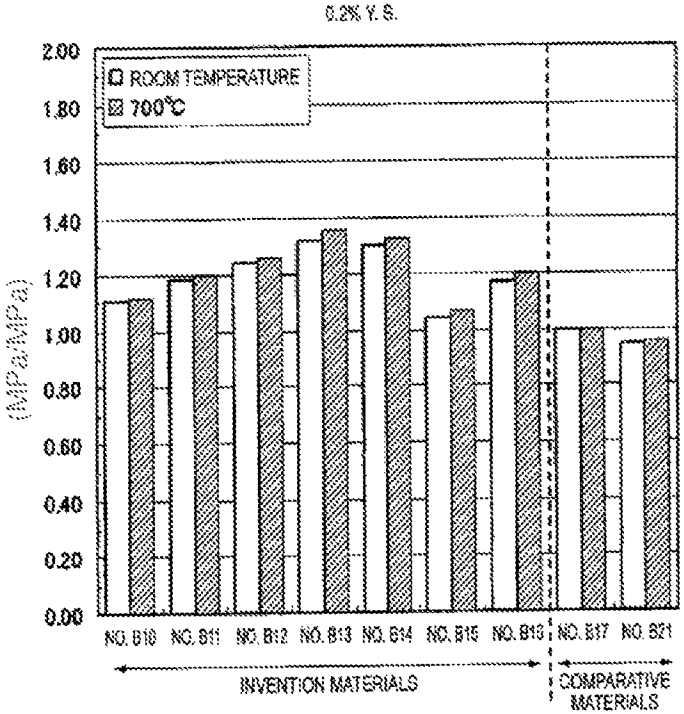
FIG. 4 A graph showing the 0.2% yield strengths (Y.S.) at room temperature and a high temperature (700° C.) of test materials in Example.
Figure 6:
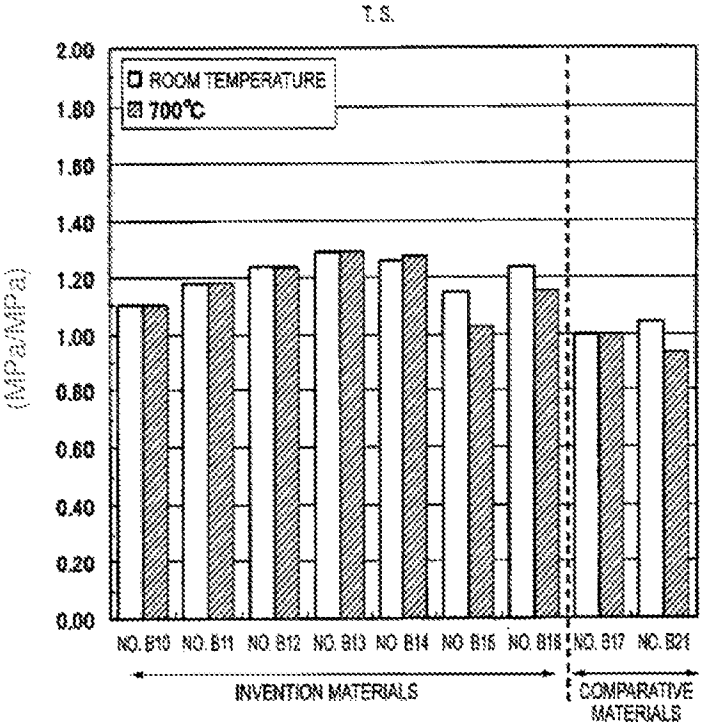
FIG. 6 A graph showing the tensile strengths (T.S.) at room temperature and a high temperature (700° C.) of test materials in Example.
Figure 7:
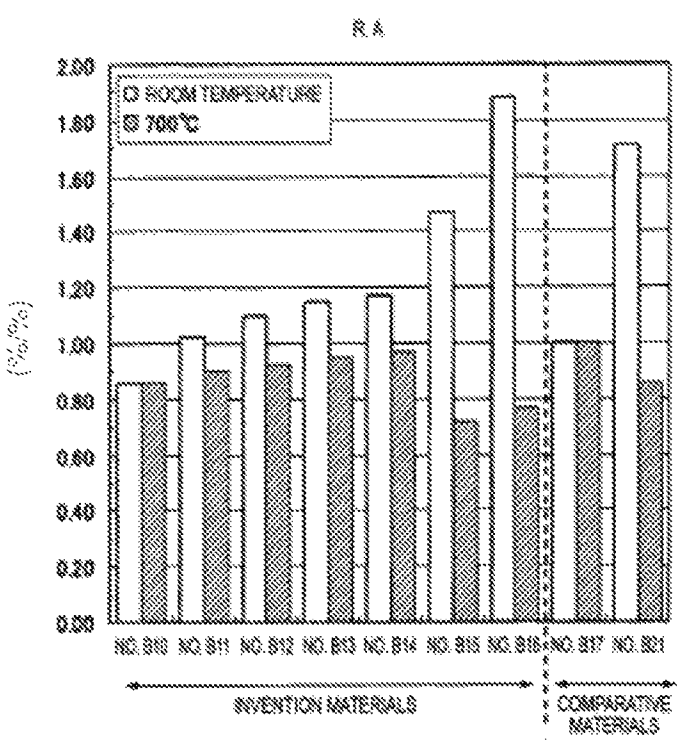
FIG. 7 A graph showing the reductions of area (R.A.) at room temperature and a high temperature (700° C.) of test materials in Example.
Figure 8:
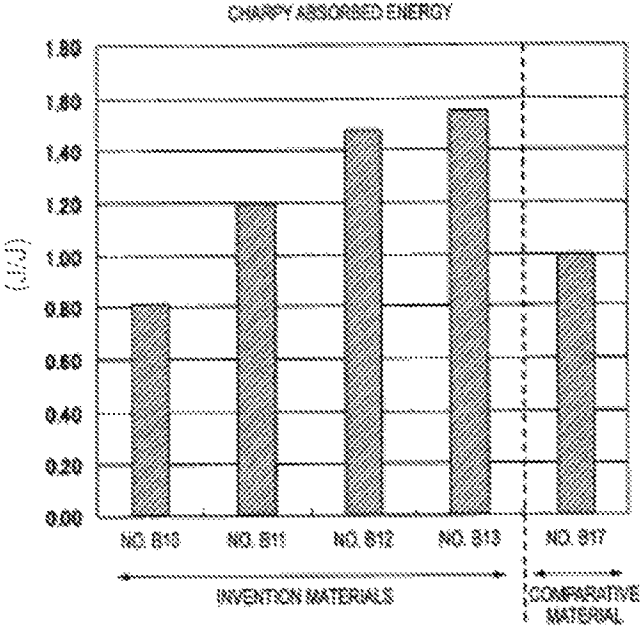
FIG. 8 A graph showing the values of Charpy absorbed energy of test materials in Example.

The test materials obtained were subjected to a room-temperature tensile test, high-temperature (700° C.) tensile test, and Charpy impact test. In FIGS. 4 to 8 are shown the results of comparative evaluation in which the room-temperature and 700° C. values of the various material properties for comparative material No. B17 were taken as 1. As shown in FIG. 4 and FIG. 6, the invention materials (No. B10 to No. B14; and No. B15 and No. B16) obtained by adding Co to the comparative materials (No. B17; and No. B21), which differed in composition, increased in tensile strength and 0.2% yield strength with increasing Co addition amount with respect to the short-time tensile properties as determined at both room temperature and 700° C. On the other hand, invention materials (No. B10, No. B11, and No. B15) were lower in room-temperature ductility (elongation)

than the comparative materials (No. B17 and No. B21) because of the increased strength thereof, as shown in FIG. 5. However, these invention materials increased in ductility with increasing Co addition amount. The results obtained show that invention materials (No. B12 to No. B14 and No. B16) had greater room-temperature ductility than the comparative materials despite their increased strength.

With respect to Charpy absorbed energy also, the energy increased with increasing Co addition amount. Invention materials (No. B11 to No. B13) were higher in the absorbed energy than a comparative material (No. B17). It was thus ascertained that these invention materials had sufficient mechanical properties despite the addition of Co thereto.

While the invention has been described in detail and with reference to specific embodiments thereof, it will be apparent to one skilled in the art that various changes and modifications can be made therein without departing from the spirit and scope thereof. This application is based on a Japanese patent application filed on Feb. 13, 2008 (Application No. 2008-31506), the contents thereof being herein incorporated by reference.

INDUSTRIAL APPLICABILITY

The Ni-based alloy material of the invention can be used as a material for turbine rotors or the like as generator members. However, applications of the invention should not be construed as being limited to those members, and the Ni-based alloy is usable in various applications where high-temperature strength properties and the like are required. The alloy of the invention further has excellent high-temperature long-term stability and can, of course, be used in the temperature range of, e.g., about 600-650° C., in which related-art generator members are used.

The invention claimed is:

1. A Ni-based superalloy, consisting of: 0.005 to 0.15 mass % of C; 8 to 15 mass % of Cr; 5 to 30 mass % of Co; equal to or greater than 3.4 and less than 9 mass % of Mo; 7 to 21 mass % of W; 0.1 to 2.0 mass % of Al; 0.3 to 2.5 mass % of Ti; up to 0.015 mass % of B; 0.001 to 0.005 mass % of S; 0.0005 to 0.0022 mass % of Mg; 0.01 to 0.02 mass % of Si; one or the two of Nb and Ta in such a total amount as to result in Nb+½Ta≤1.5 mass %, and optionally one or more elements selected from the group consisting of Zr and Hf, with the remainder being Ni and unavoidable impurities.

2. The Ni-based superalloy according to claim 1, wherein the Ni-based superalloy is for use as a material for a forging as a generator member or for a casting as a generator member.

3. The Ni-based superalloy according to claim 1, wherein the amount of Cr is from 10 to 15 mass %.

4. The Ni-based superalloy according to claim 1, wherein the amount of C is from 0.01 to 0.08 mass %.

5. The Ni-based superalloy according to claim 1, wherein the amount of Co is from 12 to 30 mass %.

6. The Ni-based superalloy according to claim 1, wherein an amount of Mg combines with an amount of S to form a sulfide.

7. A Ni-based superalloy, consisting of: 0.005 to 0.15 mass % of C; 10.2 to 15 mass % of Cr; 5 to 30 mass % of Co; equal to or greater than 1 and less than 9 mass % of Mo; 7 to 21 mass % of W; 0.1 to 2.0 mass % of Al; 0.3 to 2.5 mass % of Ti; up to 0.015 mass % of B; 0.001 to 0.005 mass % of S; 0.0005 to 0.0022 mass % of Mg; 0.01 to 0.02 mass % of Si; and optionally one or more elements selected from the group consisting of Zr, Hf, Nb and Ta, with the remainder being Ni and unavoidable impurities, wherein the total content of Mo+W is more than 10%.

8. The Ni-based superalloy according to claim 7, wherein the amount of Mo is equal to or greater than 3 and less than 9 mass %.

9. The Ni-based superalloy according to claim 7, wherein the amount of Al is 0.1 to 1.5 mass %.

10. A Ni-based superalloy, consisting of: 0.005 to 0.15 mass % of C; 8 to 15 mass % of Cr; 5 to 30 mass % of Co; equal to or greater than 3.4 and less than 9 mass % of Mo; 7 to 21 mass % of W; 0.1 to 2.0 mass % of Al; 0.3 to 2.5 mass % of Ti; up to 0.015 mass % of B; 0.001 to 0.005 mass % of S; 0.0005 to 0.0022 mass % of Mg; 0.01 to 0.02 mass % of Si; one or the two of Nb and Ta in such a total amount as to result in Nb+½Ta≤1.5 mass %, and one or the two of up to 0.2 mass % of Zr and up to 0.8 mass % of Hf, with the remainder being Ni and unavoidable impurities.

* * * * *